US005188295A

United States Patent [19]

Stern et al.

[11] Patent Number: 5,188,295

[45] Date of Patent: * Feb. 23, 1993

[54] MANUALLY ADJUSTABLE SPRAY APPLICATOR

[75] Inventors: Donald J. Stern; Jeff S. Heaton, both of Bellingham; James A. Tryon, Seattle; Brett A. Bartholmey, Bellingham, all of Wash.

[73] Assignee: DJS & T Limited Partnership, Bellingham, Wash.

[ * ] Notice: The portion of the term of this patent subsequent to Sep. 11, 2007 has been disclaimed.

[21] Appl. No.: 801,959

[22] Filed: Dec. 2, 1991

Related U.S. Application Data

[63] Continuation-in-part of Ser. No. 560,424, Jul. 31, 1990, Pat. No. 5,069,390, which is a continuation of Ser. No. 321,759, Mar. 10, 1989, Pat. No. 4,955,545.

[51] Int. Cl.[5] ..... B05B 7/24

[52] U.S. Cl. ..... 239/320; 239/345; 239/369; 239/375; 222/325; 222/401; 222/631

[58] Field of Search ..... 239/320, 345, 346, 355, 239/369, 375, 581.2, 456, 457, 458, 539; 222/325, 326, 285, 286, 394, 383, 401, 631

[56] References Cited

U.S. PATENT DOCUMENTS

| | | | |
|---|---|---|---|
| 604,151 | 5/1898 | Horn | 239/345 |
| 625,594 | 5/1899 | Oldham | 239/369 |
| 1,770,011 | 8/1930 | Poston | 239/548 |
| 1,988,017 | 1/1935 | Norwick | 239/378 |
| 2,887,274 | 5/1959 | Swenson | 239/375 |
| 4,195,780 | 4/1980 | Inglis | 239/457 |
| 4,411,387 | 10/1983 | Stern et al. | 239/345 |
| 5,039,017 | 8/1991 | Howe | 239/346 |

*Primary Examiner*—Kevin P. Shaver
*Assistant Examiner*—Karen B. Merritt
*Attorney, Agent, or Firm*—Hughes & Multer

[57] ABSTRACT

A spray applicator to discharge plaster or another texturizing material in a spray pattern against a wall surface or the like. There is a manually operable air cylinder and piston assembly which discharges pressurized air through a first nozzle, with an air jet traveling through an area where the plaster or the material descends from a container, with the air jet carrying some of the plaster through a forward discharge nozzle to cause a spray pattern. There is rotatable fluid discharge nozzle portion which is, by said rotation, moved toward and away from an air discharge nozzle.

20 Claims, 6 Drawing Sheets

112
120
122
118
140
138
158
160
114
111
110
146
130
132
154
150
134
148
183
180
152
116
174
166
172
164
176
168
178
170
136
156
182
128
126
124
162
142
111
112
114
118
110
138
160
140
122
158
120
132
130
146
181

MANUALLY ADJUSTABLE SPRAY APPLICATOR

CROSS-REFERENCE TO RELATED APPLICATIONS

This is a continuation-in-part of U.S. patent application 07/560,424, now U.S. Pat. No. 5,069,390 filed Jul. 31, 1990, entitled "MANUALLY ADJUSTABLE SPRAY APPLICATOR", which is in turn a continuation of U.S. patent application Ser. No. 07/321,759, now U.S. Pat. No. 4,955,545 filed Mar. 10, 1989.

BACKGROUND OF THE INVENTION

1. Field of the Invention

The present invention relates generally to compression spray applicators for coating fluid and more particularly to such a spray applicator for spraying viscous fluids, such as plaster or other texturizing material, onto a wall, ceiling or the like.

2. Background Art

There are in the prior art spray applicators where there is a chamber which contains a viscous fluid, such as plaster, with a forward fluid discharge nozzle through which the plaster is sprayed. There is a source of pressurized air (e.g., a manually operated cylinder and piston air pump, or possibly an air pressure structure which can be attached to a powered air compressor) from which air is discharged through an air nozzle which is axially aligned with, and positioned rearwardly of, the fluid discharge nozzle. The plaster or other material to be discharged moves into alignment with fluid discharge nozzle, and an air jet from the air nozzle propels the plaster or other fluid through the fluid nozzle in a spray pattern.

One such spray applicator is shown in U.S. Pat. No. 4,411,387 (Stern et al.), issued Oct. 25, 1983 and entitled "MANUALLY OPERATED SPRAY APPLICATOR". There is shown a spray applicator where there is a cylinder defining an air chamber, with a manually operated piston being positioned in the chamber in a manner that reciprocating motion of the piston causes air to pass through an air nozzle during the forward stroke of the piston. When the air in the air chamber becomes pressurized, it acts on a nozzle positioning plate to move the air nozzle rearwardly away from the fluid nozzle to permit the plaster or other fluid to pass into alignment with the fluid discharge nozzle so that this plaster or other fluid is discharged in a spray pattern. One of the problems toward which this patent is particularly directed is to stop the "dribbling" of the plaster or other material from the fluid discharge nozzle at the end of the piston stroke when the air pressure in the air chamber is dropping back to atmospheric pressure. To alleviate this, the apparatus is arranged so that just before the completion of the compression stroke of the piston, a pressure relief passageway is opened to permit a spring acting on the nozzle member to move the nozzle member forwardly to a closed position. On a subsequent stroke of the piston, the forward motion of the piston again pressurizes the air chamber to act through a passageway to act on the positioning plate to move the air nozzle rearwardly to its open position and again permit the discharge of the plaster or other material as a spray.

While the spray applicator described in U.S. Pat. No. 4,411,387 is certainly a practical and commercially viable design, there is perceived a need to provide a spray applicator of a simplified design which can be manufactured economically, yet which is reasonably effective in accomplishing a proper spray application of the plaster or other material. For example, such a simplified spray applicator would be desirable in a situation where a person needs the applicator for only limited use, such as spraying the plaster on a small area of a repair. For such an application, it may not be necessary to have all of the operating refinements of a more sophisticated spray applicator, but yet have the basic operating characteristics which provide overall effective operation.

It is toward this problem which the present invention is directed.

SUMMARY OF THE INVENTION

The present invention comprises a spray applicator to discharge a fluid material in a spray pattern by means of pressurized air. The applicator comprises a fluid discharge section that in turn comprises a mounting portion and a forwardly positioned fluid nozzle portion providing a fluid discharge nozzle means which is located on a longitudinally extending discharge axis. The fluid discharge section defines a fluid discharge region located adjacent to and rearwardly of the fluid discharge nozzle means. A fluid containing portion is mounted to said mounting portion and adapted to contain the fluid material. The containing portion has a fluid discharge opening positioned to deliver the fluid material into the discharge region.

There is an air pressurizing and supply section that is connected to the fluid discharge section and comprises a housing defining an air chamber. It further comprises an air nozzle portion positioned at a forward end of the housing and providing an air discharge nozzle means which is located at fluid discharge region rearwardly of the fluid discharge nozzle means. There is a manually operable pressurizing member mounted in the housing for motion on a pressurizing stroke to provide pressurized air in the air chamber which is discharged through the air nozzle means to cause fluid material in the discharge region to be discharged through the fluid discharge nozzle means and also for a return stroke.

At least a portion of the fluid discharge section is arranged for forward and rear movement relative to the air pressurizing and supply section in a manner that said fluid discharge nozzle means moves toward and away from said air discharge nozzle means in a manner to control discharge of the fluid material to the fluid discharge opening means. Each of the air pressure and supply section and at least said portion of the fluid discharge section are configured to be manually grasped so as to facilitate manually initiated movement toward and away from one another.

In one configuration, the applicator is provided with positioning means interengaged with the portion of the fluid discharge section in a manner that the portion of the fluid discharge section can be properly located with respect to the air nozzle portion.

Desirably, the air nozzle portion is fixedly connected to the housing, and in a preferred form is formed integrally with said housing.

Also, in one embodiment, the containing portion is removably mounted to the mounting portion. In another embodiment, the containing portion is fixedly mounted to the mounting portion.

Also, in the preferred form, the containing portion has a lower portion which extends around and defines at least partly said fluid discharge region. Also in a preferred configuration, the fluid discharge nozzle means comprises a separate nozzle member which is mounted to the containing portion.

In a preferred embodiment, the fluid nozzle portion comprises the portion of the fluid discharge section that is arranged for forward and rear movement, and the fluid nozzle portion is movably mounted to the fluid containing portion. Also in this embodiment, the fluid discharge nozzle means is rotatably mounted in a manner that rotation of the fluid discharge nozzle means causes a forward and rear movement therefore. Further in this embodiment, the fluid discharge means has a manually engageable portion that is positioned at least partly around a nozzle mounting portion so as to be able to be manually grasped. Further, the fluid discharge nozzle means comprises an inner portion defining a fluid discharge passageway, this in the preferred form being positioned within the nozzle mounting portion. In the preferred configuration the outer nozzle portion has interior threads engaging exterior threads on the nozzle mounting portion.

Other features will become apparent from the following detailed description.

BRIEF DESCRIPTION OF THE PREFERRED EMBODIMENT

Figure 1:
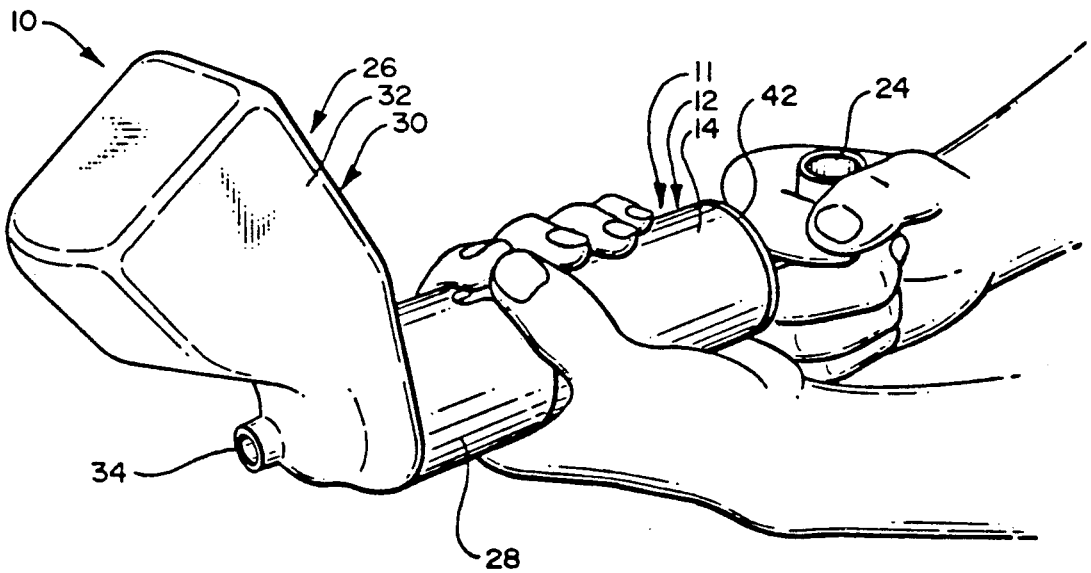
FIG. 1 is an isometric view of a first embodiment of the spray applicator of the present invention, showing the invention being manually operated.
Figure 2:
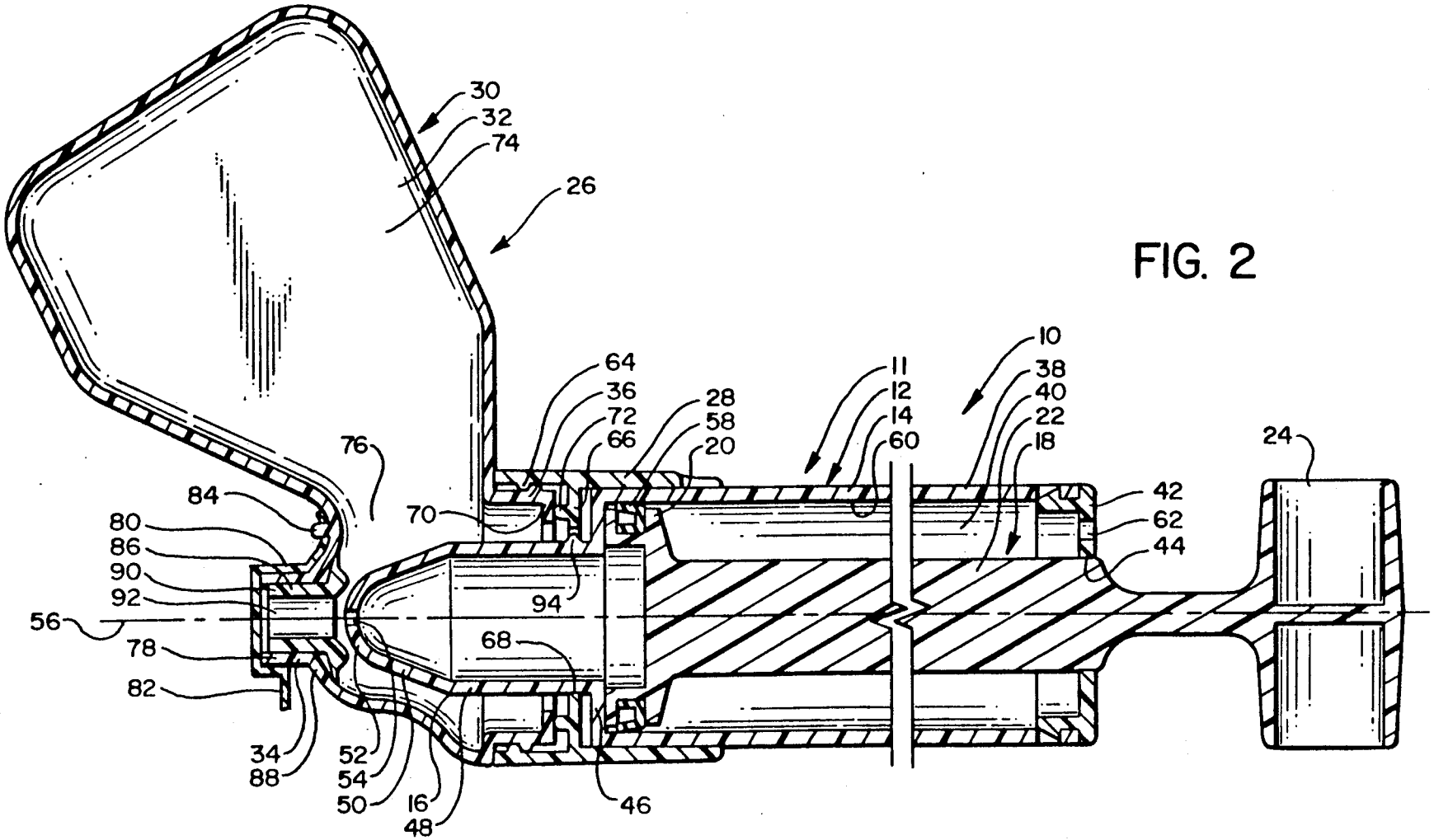
FIG. 2 is a sectional view taken along a longitudinal axis of the spray applicator of FIG. 1, with the fluid discharge nozzle being positioned at a more forward position to permit fluid, such as plaster to be discharged in a spray pattern having relatively larger particles of fluid material.
Figure 3:
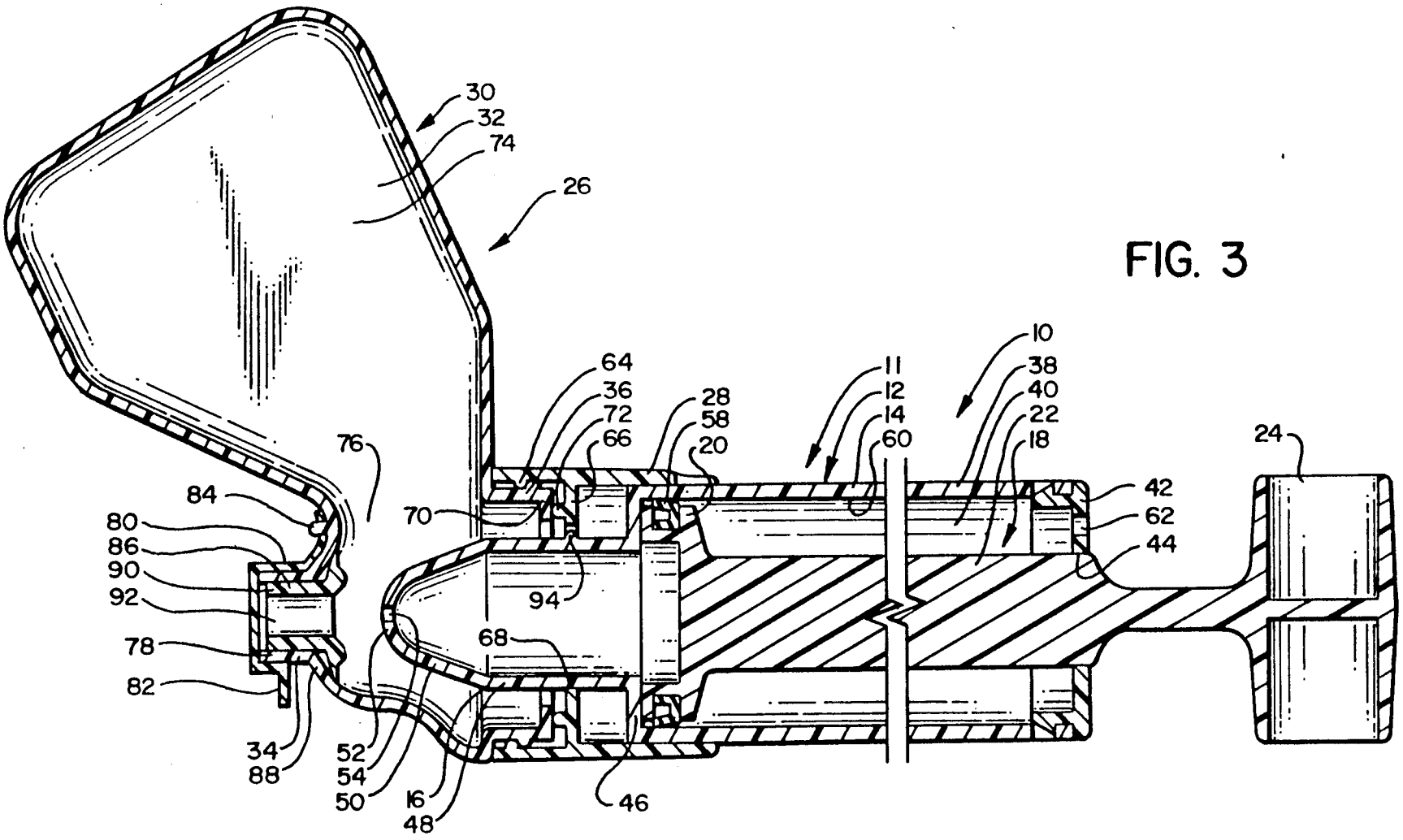
FIG. 3 is a longitudinal sectional view similar to FIG. 2, showing the fluid discharge nozzle at a rear location closely adjacent to said air nozzle so as to inhibit flow of fluid material, such as plaster, from said fluid discharge nozzle.

The apparatus 10 of a first embodiment of the present invention comprises an air pressurizing and supply means 11, which in turn comprises a housing structure 12 having an air pressurizing section 14 and an air nozzle section 16. Mounted to the housing structure 12 is a piston assembly 18, comprising an air pressurizing piston 20 connected to a rearwardly extending rod 22 that in turn is connected to a manually operable handle 24.

Mounted to the forward end of the housing structure 12 is a fluid supply and discharge means 26, which comprises first an adjustable mounting sleeve 28 and also a fluid container and discharge nozzle member 30 that is removably mounted to the front end of the mounting sleeve 28. The container and discharge nozzle member 30 has a container section 32 to contain plaster or other texturizing material, a discharge nozzle section 34, and a mounting section 36 by which the member 30 is removably mounted to the forward end of the mounting sleeve 28. In addition to serving amounting function, the mounting sleeve 28 is rotatably mounted to the housing section 12 in a manner that relative rotational movement of the sleeve 28 and the housing section 12 causes movement of the sleeve 28 in an axial direction to bring the discharge nozzle section 34 either closer to or further away from the air nozzle section 16. This is considered to be a significant feature in the present invention, and this will be described in more detail later herein.

To proceed to a more detailed description of the present invention, the air pressurizing section 14 comprises a cylindrically-shaped sidewall 38 defining an air chamber 40 in which the piston 20 reciprocates. The aft end of the cylindrical sidewall 38 is closed by an end plate or plug 42 having a through opening 44 to receive the piston rod 22. The forward end of the cylindrical sidewall 38 has a radially inwardly extending flange 46 which "necks in" to be joined integrally to rear end of the aforementioned air nozzle section 16.

The air nozzle section 16 has a rear cylindrical sidewall portion 48 which is in turn integrally connected to a frusto-conical nozzle wall 50, with the forward end of the nozzle wall 50 terminating in a forward rounded portion 52 having a central through nozzle opening 54.

For purposes of description, the apparatus 10 can be considered as having a longitudinal center axis 56 which is coincident with the longitudinal center axis of the cylindrical sidewall 38 of the housing section 12. The piston assembly 18 is centered on, and is moved forwardly and rearwardly along, this longitudinal axis 56. The air discharge opening 54 is centered on the longitudinal axis 56 and arranged to discharge on air jet forwardly along the longitudinal axis 56.

The aforementioned handle 24 is conveniently shaped as a cylindrical member which is manually grasped so that the piston assembly 18 can be reciprocated forwardly and rearwardly. The piston 20 is formed with a circumferential outer groove in which is positioned a circular seal member 58 which is arranged in a conventional manner so that on the forward stroke, an airtight seal is formed against the interior surface 60 of the cylinder wall 38, while air is permitted to pass around the seal member 58 on the rearwardly traveling return stroke. A vent opening 62 is provided in the end plate 42 to facilitate the movement of air into the chamber 40.

The aforementioned mounting sleeve 28 has its forward end provided with interior helical threads 64 which engage matching exterior threads formed in the mounting section 36 of the container and discharge nozzle member 30. Thus, this member 30 can be removably attached to the mounting sleeve 28 simply by making the threaded connection at 64. Immediately rearwardly of the threaded portion 64, the sleeve 28 is formed with an integral radially inwardly extending annular flange 66 having an inner circular surface 68 that fits against the outer surface of the cylindrical sidewall portion 48 of the air nozzle section 16.

A circular lip 70 extends a short distance outwardly from the forward surface of the flange 64, and this lip 70 engages an inner edge of a circular lip 72 formed at the rear end of the mounting section 36 of the container and discharge nozzle member 30. The containing section 32 defines a chamber 74 which is initially filled with the material (e.g., plaster or some other texturizing material) which is to be discharged as a spray. As shown herein, this containing section 32 is formed in a somewhat rectangular configuration and has an upward and forward slope so as to be configured to cause the plaster or texturizing material contained therein to flow by gravity downwardly to the area of the discharge nozzle section 34, yet with the containing section 32 being positioned at a sufficiently far forward location to permit the mounting sleeve 28 and housing section 12 to be conveniently grasped manually. The lower end of the containing section 32 is formed with a throat 83 through which the plaster or texturizing material flows downwardly into the discharge area.

The aforementioned nozzle section 34 comprises first a mounting portion having a forwardly extending cylindrical wall 78 on which a closure cap 80 can be removably mounted. This closure cap 80 (as shown herein) has a tab 82 which can be manually grasped to remove the cap 80 from engagement with the mounting wall 78. Also, as shown herein there is a mounting tab 84 by which the cap 80 can be attached to the member 30 at a location just above the mounting wall 78.

There is a separately formed nozzle element 86 having a frusto-conical wall 88 bonded to a matching frusto-conical portion of the nozzle discharge section 34. There is a cylindrical shaped discharge portion 90 defining a through opening 92 through which the plaster, texturizing material or other material is discharged in a spray pattern.

It will be noted that the discharge portion 90 of the nozzle element 86 is centered on the longitudinal axis 56 so that the fluid discharge opening 92 and the air nozzle opening 54 are aligned with one another.

Figure 4:
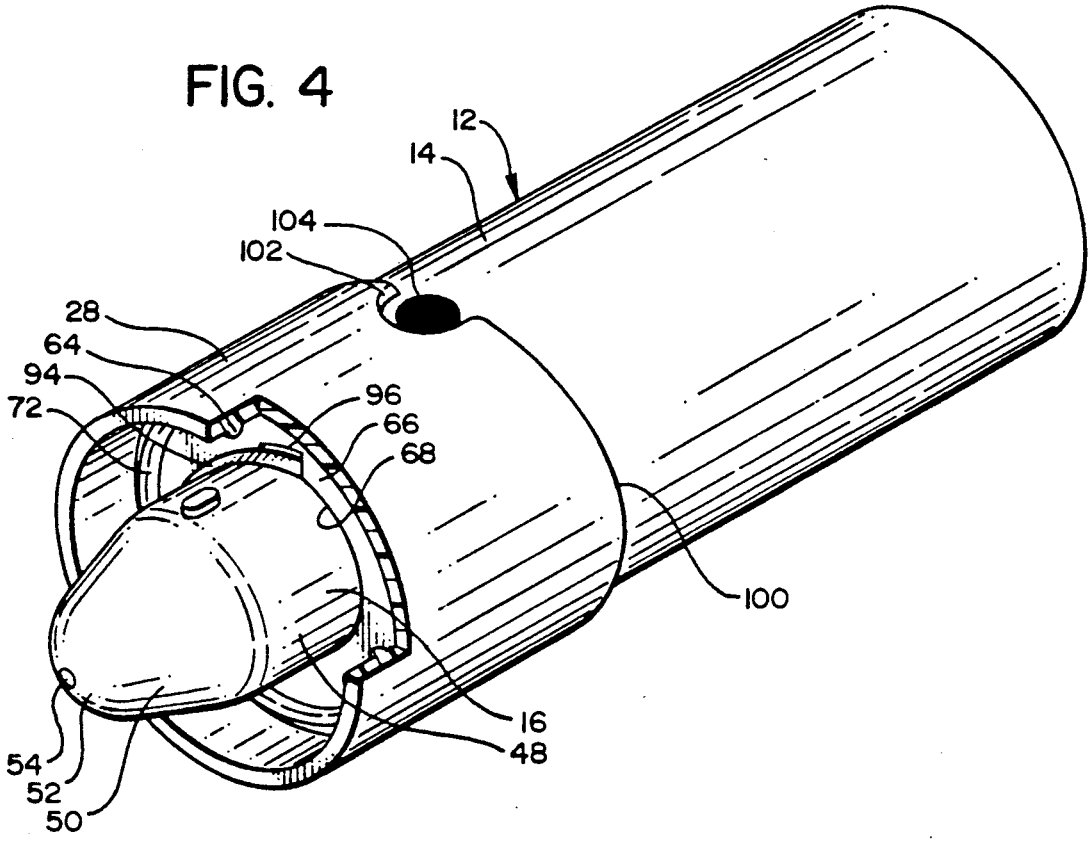
FIG. 4 is an isometric view showing only the housing structure with the air discharge nozzle, and also showing a portion of a mounting section which is mounted to the housing structure in a manner to be movable forwardly and rearwardly to cause the fluid discharge nozzle to be located at its forward and rear locations, as shown in FIGS. 2 and 3, with certain components or portions of the apparatus being omitted for ease of illustration.

It was mentioned earlier herein that the mounting sleeve 28 can be moved rotatably relative to the housing 12 to cause forward and rear adjustment of the fluid discharge nozzle section 34. This is accomplished by forming the cylindrical sidewall 48 of the air nozzle section 16 with a raised helical locating ridge or thread 94 that is received in a locating opening 96 that is formed at the interior edge surface 68 of the flange 66. (See FIG. 4.) It is readily apparent that as the sleeve 28 rotates relative to the housing section 12, the locating ridge 94 acts as a locating cam or member to cause the sleeve 28 to translate axially along the longitudinal center axis 56. In the present configuration, this locating ridge 94 is approximately 180 degrees in length.

The rear circumferential edge 100 of the sleeve 28 is conveniently provided with a circular cutout 102 which can be matched with markings (one of which is indicated schematically at 104) so that the axial spacing distance of the air nozzle section 14 and the fluid discharge nozzle section 36 can readily be determined.

To describe the operation of the first embodiment of the present invention, plaster, texturizing material or some other fluid material is placed in the containing section 32 of the container and discharge member 30. The mounting sleeve 28 is rotated to the desired location, so that the air nozzle section 16 and the discharge nozzle section 34 are spaced from one another at the desired distance. When these two nozzle sections are positioned closely adjacent to one another, the viscous material in he containing section 32 does not flow out the discharge nozzle opening 92. The relative location of the discharge nozzle section 34 to the air nozzle section 16 determines the particle size of the material which is discharged from the spray applicator 10.

The mounting sleeve 28 is rotated to the appropriate location so as to optimize the distance between the nozzle sections 16 and 34, the handle 24 is manually grasped with one hand, while the housing section 12 is grasped with the other hand. Then the piton assembly 18 is reciprocated so that on the forward stroke, air in the cylinder chamber 40 is pressurized so that an air jet is discharged in a forward direction from the air nozzle opening 54. This air jet in turn causes particles of the plaster or other texture material to flow with the air out the discharge opening 92 in a spray pattern, so that this material is deposited in the desired arrangement on a wall or ceiling surface. On the return stroke of the piston 20, air flows past the piston 20 into the air chamber 40 to be discharged on the next forward pressure stroke of the piston 20.

As indicated above, the mounting sleeve 28 can be rotated to provide the optimized axial spacing distance between the nozzle members 16 and 34. Upon completing of the spraying application, the sleeve 28 is rotated to bring the nozzle sections 16 and 34 closely adjacent to one another to limit further flow of the plaster or the texture material from the discharge opening 92. Also, the closure+ cap 80 can be placed over the cylindrical mounting wall 78 to totally close off the discharge opening 92.

Figure 5:
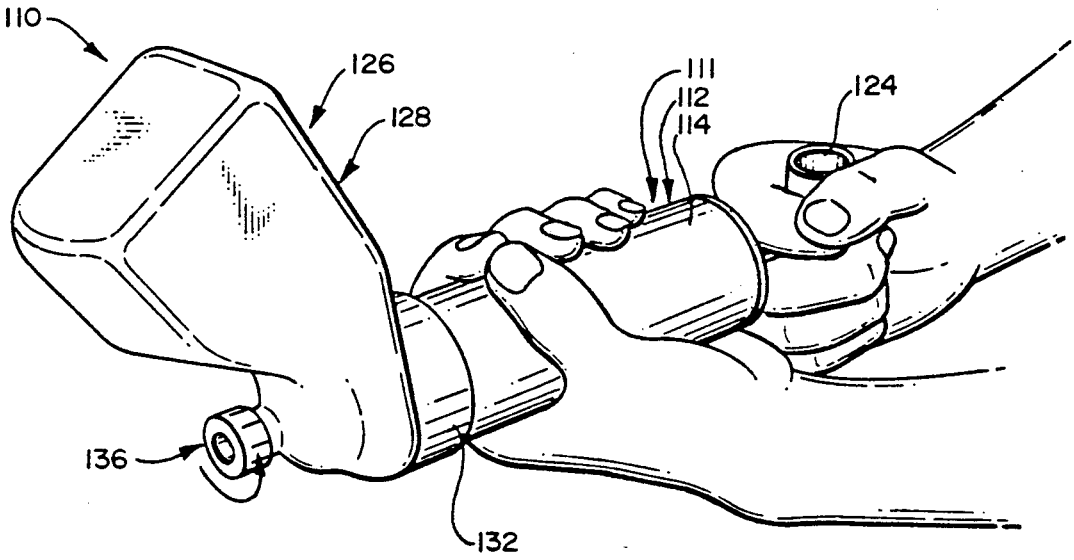
FIG. 5 is an isometric view, similar to FIG. 1, showing a second embodiment of the present invention.
Figures 6, 7:
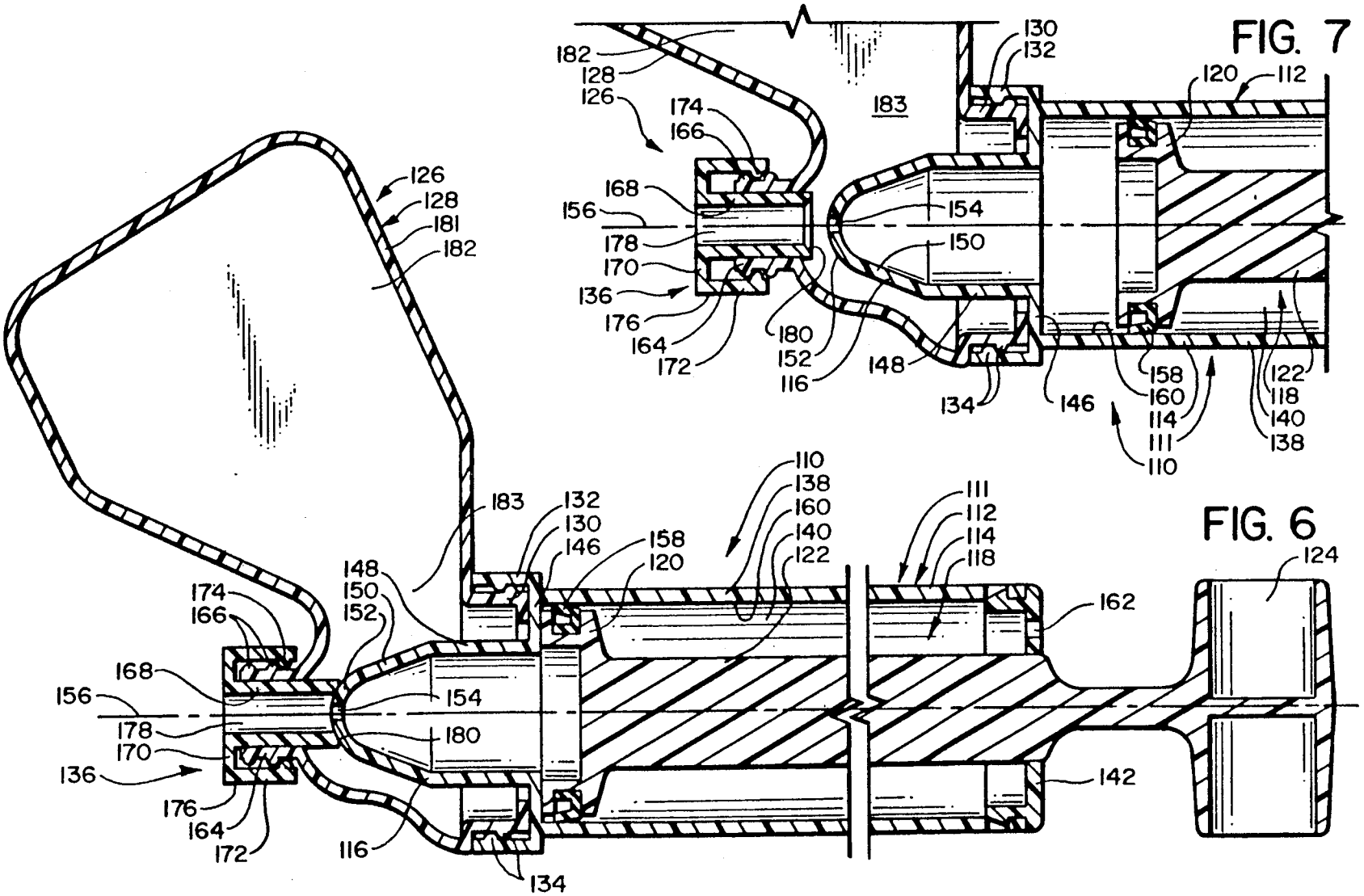
FIG. 6 is a longitudinal sectional view (similar to FIG. 2) of the second embodiment shown in FIG. 5, with the fluid discharge nozzle being positioned at a more rearward position to inhibit flow of fluid material, such as plaster, from the fluid discharge nozzle.
FIG. 7 is a longitudinal sectional view of only a forward portion of the embodiment of FIG. 5, showing the fluid discharge nozzle at a more forward position to permit fluid, such as plaster, to be discharged in a spray pattern.

The apparatus 110 of a second embodiment of the present invention is shown in FIGS. 5–7. This second embodiment 110 comprises an air pressurizing and supply means 111, which in turn comprises a housing structure 112 having an air pressurizing section 114 and an air nozzle section 116. Mounted to the housing structure 112 is a piston assembly 118, comprising an air pressurizing piston 120 connected to a rearwardly extending rod 122 that in turn is connected to a manually operable handle 124.

Mounted to the forward end of the housing structure 112 is a fluid supply and discharge means 126, which comprises first a fluid containing section 128 having a mounting portion in the form of a cylindrical mounting fitting 130 by which the container section 128 is removably mounted to the front end of the housing 112. The housing 112 has a forwardly extending mounting collar 132 formed integrally therewith to connect to the mounting fitting 130, by receiving the fitting 130 inside the collar 132 with a snap fit by means of interengaging lips 134. The containing section 128 is arranged to contain plaster or other texturizing material.

There is a discharge nozzle section 136 which is adjustably mounted to a lower forward end of the containing section 128. The nozzle section 136 is rotatably mounted to the section 128 in a manner that relative rotational movement of the nozzle section 136 and the containing section 128 causes movement of the nozzle section 136 in an axial direction to bring the discharge nozzle section 136 either closer to or further away from the air nozzle section 116. This is considered to be a significant feature in the present invention, and this will be described in more detail later herein.

To proceed to a more detailed description of the present invention, the air pressurizing section 114 comprises a cylindrically-shaped sidewall 138 defining an air chamber 140 in which the piston 120 reciprocates. The aft end of the cylindrical sidewall 138 has a radially inwardly extending flange 146 which "necks in" to be joined integrally to rear end of the aforementioned air nozzle section 116.

The air nozzle section 116 has a rear cylindrical sidewall portion 148 which is in turn integrally connected to a frusto-conical nozzle wall 150, with the forward end of the nozzle wall 150 terminating in a forward rounded portion 152 having a central through nozzle opening 154.

As in the description of the first embodiment 10, for purposes of description, the apparatus 110 can be considered as having a longitudinal center axis 156 which is coincident with the longitudinal center axis of the cylindrical sidewall 138 of the housing section 112. The piston assembly 118 is centered on, and is moved forwardly and rearwardly along, this longitudinal axis 156. The air discharge opening 154 is centered on the longitudinal axis 156 and arranged to discharge on air jet forwardly along the longitudinal axis 156.

The aforementioned handle 124 is conveniently shaped as a cylindrical member which is manually grasped so that the piston assembly 118 can be reciprocated forwardly and rearwardly. The piston 120 is formed with a circumferential outer groove in which is positioned a circular seal member 158 which is arranged in a conventional manner so that on the forward stroke, an airtight seal is formed against the interior surface 160 of the cylinder wall 138, while air is permitted to pass around the seal member 158 on the rearwardly traveling return stroke. A vent opening 162 is provided in the end plate 142 to facilitate the movement of air into and from the chamber 140.

The aforementioned nozzle section 136 is adjustably mounted to a cylindrical mounting member 164 that is fixedly connected to (more precisely integrally formed with) a lower forward portion of the containing section 128. The center axis of this mounting member 164 is coincident with the main longitudinal axis 156 and is thus aligned with the air discharge opening 154. Further, the outer cylindrical surface of this member 164 is formed with helical threads 166.

The nozzle section 136 comprises an inner cylindrical nozzle portion 168 which is positioned in a close fit within the aforementioned mounting member 164. The forward end of the cylindrical nozzle portion 168 is formed integrally with a radially outwardly extending annular connected section 170 which in turn is integrally connected with an outer cylindrical portion 172 which in turn is positioned around the mounting member 164.

The inside surface of the outer portion 172 is formed with interior helical threads 174 which engage the helical threads 166 on the mounting member 164. Thus, it is readily apparent that by rotating the nozzle member 136, because of the inner action of the threads 166 and 174, the nozzle member 136 can be moved forwardly or rearwardly along the longitudinal center axis 156. It is also apparent that the radially outward exposed surface 176 of the outer cylindrical portion 172 is sufficiently exposed and conveniently placed so that it can easily be manually grasped to rotate the discharge nozzle section 136.

The cylindrical nozzle portion defines a discharge passageway 178 having a diameter larger than the air discharge opening 154. With the nozzle section 136 in its rear closed position, a rear circumferential edge portion 180 of the cylindrical nozzle portion 168 fits against the forward surface portion of the rounded nose portion 152 of the air nozzle section 116 (as seen in FIG. 6). However, when the nozzle section 136 is rotated to a more forward position (as in FIG. 7), the rear edge portion 180 of the nozzle portion 168 is spaced forwardly from the nose portion 152 of the air nozzle section 116.

The containing section 128 defines a chamber 182 which is initially filled with the material (e.g., plaster or some other texturizing material) which is to be discharged as a spray. As in the first embodiment, this containing section 128 is formed in a somewhat rectangular configuration and has an upward and forward slope. The lower end of the containing section 128 is formed with a throat 183 through which the plaster or texturizing material flows downwardly into the discharge region which is the area just forward of the air discharge opening 154 and rearward of the nozzle discharge section 136.

To describe the operation of the second embodiment of the present invention, plaster, texturizing material or some other fluid material is placed in the containing portion 181, and section 128 which is then connected by its mounting member 130 to the mounting collar 132. The discharge nozzle section 136 is rotated to the desired location by manually grasping the outer surface 176 of the nozzle member 136, so that the air nozzle section 116 and the discharge nozzle section 136 are spaced from one another at the desired distance. As in the first embodiment, when these two nozzle sections are positioned closely adjacent to one another or abutting one another, the viscous material in the containing and discharge section 128 does not flow out the discharge nozzle passaway 178. The relative location of the discharge nozzle section 136 to the air nozzle section 116 determines the particle size of the material which is discharged from the spray applicator 110.

After the discharge nozzle section 136 is rotated to the appropriate location so as to optimize the distance between the nozzle sections 116 and 136, the handle 124 is manually grasped with one hand, while the housing section 112 is grasped with the other hand. Then the piston assembly 118 is reciprocated as described with regard to the first embodiment so that the air jet causes particles of the plaster or other texture material to flow with the air out the discharge passaway 178 in a spray pattern.

As indicated above, the discharge nozzle 136 can be rotated to provide the optimized axial spacing distance between the nozzle sections 116 and 136. Upon completing of the spraying application, the discharge nozzle section 136 is rotated to bring the nozzle sections 116 and 136 closely adjacent to or against one another to limit further flow of the plaster or the texture material from the discharge passaway 178.

It is obvious that various modifications can be made to the present invention without departing from the basic teaching thereof.

What is claimed:

1. A spray applicator to discharge a fluid material in a spray pattern by means of pressurized air, said applicator comprising:

a. a fluid discharge section comprising:

i. a mounting portion;

ii. a forwardly positioned fluid nozzle portion providing a fluid discharge nozzle means which is located on a longitudinally extending discharge axis;

iii. said fluid discharge section defining a fluid discharge region located adjacent to and rearwardly of said fluid discharge nozzle means;

iv. a fluid containing portion mounted to said mounting portion and adapted to contain said fluid material, said containing portion having a fluid discharge opening positioned to deliver said fluid material into said discharge region;

b. an air pressurizing and supply section connected to said fluid discharge section and comprising:

i. a housing defining an air chamber;

ii. an air nozzle portion positioned at a forward end of said housing and providing an air discharge nozzle means which is located at said fluid discharge region rearwardly of said fluid discharge nozzle means;

iii. a manually operable pressurizing member mounted in said housing for motion on a pressurizing stroke to provide pressurized air in said air chamber which is discharged through said air nozzle means to cause fluid material in said discharge region to be discharged through said fluid discharge nozzle means, and also for a return stroke;

c. at least a portion of said fluid discharge section being arranged for forward and rear movement relative to said air pressurizing and supply section in a manner that said fluid discharge nozzle means moves toward and away from said air discharge nozzle means in a manner to control discharge of said fluid material through said fluid discharge opening means, each of said air pressure and supply section and at least said portion of said fluid discharge section being configured to be manually grasped so as to facilitate manually initiated movement toward and away from one another.

2. The applicator as recited in claim 1, wherein said applicator is provided with positioning means interengaged with said portion of the fluid discharge section in a manner that said portion of said fluid discharge section can be properly located with respect to said air nozzle portion.

3. The applicator as recited in claim 1, wherein said air nozzle portion is fixedly connected to said housing.

4. The applicator as recited in claim 3, wherein said housing and said air nozzle portion are formed integrally with one another.

5. The applicator as recited in claim 1, wherein said containing portion is fixedly mounted to said mounting portion.

6. The applicator as recited in claim 5, wherein said containing portion has a lower portion which extends around and defines at least partly said fluid discharge region.

7. The applicator as recited in claim 5, wherein said fluid discharge nozzle means comprises a separate nozzle member which is mounted to said containing portion.

8. The applicator as recited in claim 7, wherein said separate nozzle member comprises the portion of the fluid discharge section that is arranged for forward and rear movement.

9. The applicator as recited in claim 1, wherein said fluid nozzle portion comprises the portion of the fluid discharge section that is arranged for forward and rear movement, and said fluid nozzle portion is moveably mounted to said fluid containing portion.

10. The applicator as recited in claim 9, wherein said containing portion has a lower portion which extends around and defines at least partly said fluid discharge region.

11. The applicator as recited in claim 9, wherein said fluid discharge nozzle means is rotatably mounted in a manner that rotation of said fluid discharge nozzle means causes the forward and rear movement thereof.

12. The applicator as recited in claim 11, wherein said containing portion comprises a nozzle mounting portion to which said fluid discharge nozzle means is rotatively mounted, with said fluid discharge nozzle means having a manually engagable portion that is positioned at least partly around said nozzle mounting portion so as to be able to be manually grasped.

13. The applicator as recited in claim 12, wherein said fluid discharge nozzle means comprises an inner portion defining a fluid discharge passageway.

14. The applicator as recited in claim 13, wherein said inner nozzle portion is positioned within said nozzle mounting portion.

15. The applicator as recited in claim 14, wherein said fluid discharge nozzle means further comprises an outer nozzle portion which has interior threads engaging exterior threads on said nozzle mounting portion.

16. The applicator as recited in claim 13, wherein said fluid discharge nozzle means further comprises an outer nozzle portion which has interior threads engaging exterior threads on said nozzle mounting portion.

17. A spray applicator to discharge a fluid material in a spray pattern by means of pressurized air, said applicator comprising:

a. a fluid discharge section comprising i. a mounting portion;

ii. a forwardly positioned fluid nozzle portion providing a fluid discharge nozzle means which is located on a longitudinally extending discharge axis;

iii. said fluid discharge section defining a fluid discharge region located adjacent to and rearwardly of said fluid discharge nozzle means;

iv. said mounting portion having a mounting connecting means adapted to connect to a fluid containing portion adapted to contain said fluid material into said discharge region;

b. an air pressurizing and supply section connected to said fluid discharge section and comprising:

i a housing defining an air chamber;

ii. an air nozzle portion positioned at a forward end of said housing and providing an air discharge nozzle means which is located at said fluid discharge region rearwardly of said fluid discharge nozzle means;

iii. a manually operable pressurizing member mounted in said housing for motion on a pressurizing stroke to provide pressurized air in said air chamber which is discharged through said air nozzle means to cause fluid material in said discharge region to be discharged through said fluid discharge nozzle means, and also for a return stroke;

c. at least a portion of said fluid discharge section being arranged for forward and rear movement relative to said air pressurizing and supply section in a manner that said fluid discharge nozzle means moves toward and away from said air discharge nozzle means in a manner to control discharge of said fluid material through said fluid discharge nozzle means, each of said air pressure and supply section and at least said portion of said fluid discharge section being configured to be manually grasped so as to facilitate manually initiated movement toward and away from one another.

18. The applicator as recited in claim 17, wherein said applicator is provided with positioning means interengaged with said portion of the fluid discharge section in a manner that said portion of said fluid discharge section can be properly located with respect to said air nozzle portion.

19. The applicator as recited in claim 18, wherein said portion of the fluid discharge section that is arranged for forward and rear movement has a threaded connection so that rotation of said portion causes said forward and rear movement.

20. The applicator as recited in claim 17, wherein said air nozzle portion is fixedly connected to said housing.

* * * * *